US007461708B2

(12) United States Patent
Yong et al.

(10) Patent No.: US 7,461,708 B2
(45) Date of Patent: Dec. 9, 2008

(54) ELASTOMERIC SEAL ASSEMBLY HAVING AUXILIARY ANNULAR SEAL COMPONENTS

(75) Inventors: Zhou Yong, Spring, TX (US); Sudarsanam Chellappa, Houston, TX (US)

(73) Assignee: Smith International, Inc., Houston, TX (US)

( * ) Notice: Subject to any disclaimer, the term of this patent is extended or adjusted under 35 U.S.C. 154(b) by 319 days.

(21) Appl. No.: 10/918,993

(22) Filed: Aug. 16, 2004

(65) Prior Publication Data

US 2006/0032673 A1 Feb. 16, 2006

(51) Int. Cl.
*E21B 10/25* (2006.01)
*E21B 10/22* (2006.01)

(52) U.S. Cl. ..... 175/371; 175/359; 277/589; 277/407; 277/377

(58) Field of Classification Search ..... 175/371, 175/372, 359; 277/377, 379, 404, 589, 584; 384/94

See application file for complete search history.

(56) References Cited

U.S. PATENT DOCUMENTS

| | | | | | |
|---|---|---|---|---|---|
| 3,718,338 | A | * | 2/1973 | Traub | 277/584 |
| 3,761,145 | A | * | 9/1973 | Schumacher, Jr. | 384/94 |
| 3,990,525 | A | | 11/1976 | Penny | 175/337 |
| 4,172,502 | A | | 10/1979 | Van Nederveen | 175/369 |
| 4,176,848 | A | * | 12/1979 | Lafuze | 175/371 |
| 4,179,003 | A | | 12/1979 | Cooper et al. | 175/371 |
| 4,194,795 | A | * | 3/1980 | Rife | 384/93 |
| 4,199,156 | A | | 4/1980 | Oldham et al. | 277/92 |
| 4,200,343 | A | * | 4/1980 | Highsmith | 384/94 |
| 4,248,484 | A | | 2/1981 | Newcomb | 308/8.2 |
| 4,249,622 | A | * | 2/1981 | Dysart | 175/227 |
| 4,252,330 | A | | 2/1981 | Crow | 277/92 |
| 4,256,351 | A | | 3/1981 | Langford, Jr. | 308/8.2 |
| 4,306,727 | A | * | 12/1981 | Deane et al. | 277/381 |
| 4,359,111 | A | | 11/1982 | Gonzalez | 175/227 |
| 4,367,904 | A | | 1/1983 | Olschewski et al. | 384/95 |
| 4,394,020 | A | | 7/1983 | Oelke | 277/1 |
| 4,428,588 | A | | 1/1984 | Oelke | 277/83 |
| 4,429,854 | A | | 2/1984 | Kar et al. | 384/94 |
| 4,466,621 | A | | 8/1984 | Garner et al. | 277/84 |
| 4,466,622 | A | | 8/1984 | Deane et al. | 277/92 |
| 4,516,641 | A | | 5/1985 | Burr | 175/228 |

(Continued)

OTHER PUBLICATIONS

British Search Report for Appln. No. GB0516356.3 dated May 18, 2006; (pp. 3).

*Primary Examiner*—Shane Bomar
(74) *Attorney, Agent, or Firm*—Conley Rose, P.C.

(57) ABSTRACT

A drill bit and seal assembly therefor include a seal gland, an elastomeric sealing seal disposed in the seal gland and having a dynamic sealing surface and a static sealing surface, and at least one auxiliary elastomeric annular seal member disposed between the static sealing surface of the sealing seal and the seal gland. The auxiliary annular seal member serves to prevent relative movement of the sealing seal relative to the surfaces of the seal gland and to permit sealing seals of various cross-sections and shapes to adapt to and function with a conventionally sized and shaped gland. The auxiliary annular seal member is sized and configured and its material properties selected so as to impart the appropriate squeeze to the sealing seal to provide the desired contact pressure and footprint. Choice of the appropriate auxiliary seal member may permit the same sized seal to be employed in seal glands of differing sizes.

53 Claims, 8 Drawing Sheets

U.S. PATENT DOCUMENTS 4,613,005 A 9/1986 Olsson ..... 175/371
4,629,338 A * 12/1986 Ippolito ..... 384/94
4,666,001 A 5/1987 Burr ..... 175/371
4,671,368 A 6/1987 Burr ..... 175/371
4,747,604 A * 5/1988 Nakamura ..... 277/382
4,753,303 A 6/1988 Burr ..... 175/367
4,753,304 A * 6/1988 Kelly, Jr. ..... 175/371
4,762,189 A 8/1988 Tatum ..... 175/371
4,813,502 A 3/1989 Dysart ..... 175/337
4,838,365 A 6/1989 Kotch ..... 175/371
4,903,786 A * 2/1990 Welsh ..... 175/367
4,923,020 A 5/1990 Kelly, Jr. et al. ..... 175/372
5,005,989 A 4/1991 Karlsson ..... 384/94
5,009,519 A * 4/1991 Tatum ..... 384/94
5,027,911 A 7/1991 Dysart ..... 175/57
5,040,624 A 8/1991 Schumacher et al. ..... 175/371
5,080,183 A 1/1992 Schumacher et al. ..... 175/371
5,295,549 A 3/1994 Dolezal et al. ..... 175/371
5,360,076 A * 11/1994 Kelly et al. ..... 175/371
5,362,073 A 11/1994 Upton et al. ..... 277/92
5,472,058 A 12/1995 Hooper et al. ..... 175/371
5,791,421 A * 8/1998 Lin ..... 175/371
5,842,701 A * 12/1998 Cawthorne et al. ..... 277/336
5,875,861 A 3/1999 Daly et al. ..... 175/371
RE36,452 E 12/1999 Upton et al. ..... 277/336
6,026,917 A 2/2000 Zahradnik et al. ..... 175/371
6,033,117 A * 3/2000 Cariveau et al. ..... 384/94
6,068,070 A 5/2000 Scott ..... 175/428
6,109,376 A 8/2000 Pearce ..... 175/371
6,123,337 A 9/2000 Fang et al. ..... 277/336
6,142,249 A 11/2000 Zahradnik et al. ..... 175/371
6,170,830 B1 * 1/2001 Cawthorne et al. ..... 277/336
6,176,330 B1 1/2001 Burr ..... 175/371
6,176,331 B1 1/2001 Jin et al.
6,179,296 B1 1/2001 Cawthorne et al. ..... 277/336
6,196,339 B1 3/2001 Portwood et al. ..... 175/371
6,209,185 B1 4/2001 Scott
6,247,545 B1 6/2001 Burr et al. ..... 175/371
6,254,275 B1 7/2001 Slaughter, Jr. et al. ..... 384/92
6,305,483 B1 * 10/2001 Portwood ..... 175/371
6,536,542 B1 3/2003 Fang et al. ..... 175/371
6,598,690 B2 7/2003 Peterson ..... 175/371
6,837,317 B2 * 1/2005 Byrd ..... 175/371
7,000,712 B2 * 2/2006 Byrd ..... 175/371
7,117,961 B2 * 10/2006 Yong et al. ..... 175/371
2002/0108788 A1 * 8/2002 Peterson et al. ..... 175/228
2004/0040747 A1 3/2004 Neville et al.
2005/0023042 A1 * 2/2005 Yong et al. ..... 175/372
2005/0274549 A1 * 12/2005 Yong et al. ..... 175/371

* cited by examiner

ELASTOMERIC SEAL ASSEMBLY HAVING AUXILIARY ANNULAR SEAL COMPONENTS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The invention relates generally to seal assemblies for sealing between a rotating and a static member. In one aspect, and more particularly, the invention relates to seals for rolling cone bits as used to drill boreholes for the ultimate recovery of oil, gas or minerals. Still more particularly, the invention relates to elastomeric seals that seal and protect the bearing surfaces between the rolling cone cutters and the journal shafts on which they rotate.

2. Description of the Related Art

An earth-boring drill bit is typically mounted on the lower end of a drill string. With weight applied to the drill string, the drill string is rotated such that the bit engages the earthen formation and proceeds to form a borehole along a predetermined path toward a target zone.

A typical earth-boring bit includes one or more rotatable cone cutters. The cone cutters roll and slide upon the bottom of the borehole as the drillstring and bit are rotated, the cone cutters thereby engaging and disintegrating the formation material in their path. The rotatable cone cutters may be described as generally conical in shape and are therefore referred to as rolling cones.

Rolling cone bits typically include a bit body with a plurality of journal segment legs. The rolling cones are mounted on bearing pin shafts (also called journal shafts or pins) that extend downwardly and inwardly from the journal segment legs. As the bit is rotated, each cone cutter is caused to rotate on its respective journal shaft as the cone contacts the bottom of the borehole. The borehole is formed as the action of the cone cutters removes chips of formation material ("cuttings" or "drilled solids") which are carried upward and out of the borehole by the flow of drilling fluid which is pumped downwardly through the drill pipe and out of the bit. Liquid drilling fluid is normally used for oil and gas well drilling, whereas compressed air is generally used as the drilling fluid in mining operations.

Seals are provided in glands formed between the rolling cones and their journal shafts to prevent lubricant from escaping from around the bearing surfaces and to prevent the cutting-laden, and thus abrasive, drilling fluid from entering between the cone and the shaft and damaging the bearing surfaces. When cuttings are conveyed into the seal gland, they tend to adhere to the gland and/or seal component surfaces, and may cause undesirable increased deflection and wear to the seal components. Moreover, the cuttings can accelerate abrasive wear of all seal components and of the bearing surfaces.

In oil and gas drilling, the cost of drilling a borehole is proportional to the length of time it takes to drill to the desired depth and location. The time required to drill the well, in turn, is greatly affected by the number of times the drill bit must be changed before reaching the targeted formation. This is the case because each time the drill bit wears out or fails as a borehole is being drilled, the entire string of drill pipes, which may be miles long, must be retrieved from the borehole, section by section, in order to replace the bit. Once the drill string has been retrieved and the new bit installed, the bit must be lowered to the bottom of the borehole on the drill string, which again must be constructed section by section. The amount of time required to make a round trip for replacing a bit is essentially lost from drilling operations. As is thus obvious, this process, known as a "trip" of the drill string, requires considerable time, effort and expense. It is therefore advantageous to maximize the service life of a drill bit. Accordingly, it is always desirable to employ drill bits that will be durable enough to drill for a substantial period of time with acceptable rate of penetration (ROP).

The durability of a bit and the length of time that a drill bit may be employed before it must be changed depends upon numerous factors. Importantly, the seals must function for substantial periods under extremely harsh downhole conditions. The type and effectiveness of the seals greatly impact bit life and thus, are critical to the success of a particular bit design.

One cause of bit failure arises from the severe wear or damage that may occur to the bearings on which the cone cutters are mounted. These bearings can be friction bearings (also referred to as journal bearings) or roller type bearings, and are typically subjected to high drilling loads, high hydrostatic pressures, and high temperatures.

As previously mentioned, the bearing surfaces in typical bits are lubricated, and the lubricant is retained within the bit by the seals. The seal is typically in the form of a ring, and includes a dynamic seal surface, that is placed in rotating contact against a non-rotating surface, and a static seal surface that engages a surface that is stationary with respect to the seal ring. Although the bit will experience severe and changing loading, as well as a wide range of different temperature and pressure conditions, the dynamic and static seal surfaces must nevertheless remain sealingly engaged in order to prevent the lubricant from escaping and/or cuttings from entering the lubricated areas. These seals should perform these duties throughout the life of the bit's cutting structure.

In one typical arrangement, the seal includes a static seal surface adapted to form a static seal with the interior surface of the roller cone, and a dynamic seal surface adapted to form a dynamic seal with the journal shaft upon which the roller cone is rotatably mounted. The seal must endure a wide range of temperature and pressure conditions during the operation of the drill bit and still prevent lubricants from escaping and/or contaminants from entering the journal bearing. Elastomer seals known in the art are conventionally formed from a single type of rubber or elastomeric material, or may be made of two or more materials bonded together.

The rubber or elastomeric material selected to form the seal for the journal bearings has a particular hardness, modulus of elasticity, wear resistance, temperature stability, and coefficient of friction, among other properties. Additionally, the particular geometric configuration of the seal (along with the dimensions of the seal gland) produces a selected amount of seal deflection that defines the contact pressure and seal footprint applied by the dynamic and static seal surfaces against respective journal bearing and roller cone surfaces.

The wear, temperature, and contact pressures encountered at the dynamic seal surface are different than those encountered at the static seal surface. Therefore, the type of elastomeric material and the geometry that is selected to form each seal surface is aimed at satisfying the particular operating conditions experienced by the different dynamic and static seal surfaces.

In certain prior art bits, the elastomeric seal rings are generally adapted to form static seals on outer surfaces and dynamic seals on inner surfaces thereof In such bits, the OD seal surface is arranged to form a static seal with an adjacent and concentric surface of a seal gland (where the seal gland is formed on an internal surface of a roller cone). During operation, localized temperature increases, caused by inadequate lubrication or abrasive penetration, may result in the ID seal surface becoming static by sticking to the journal shaft, and the OD seal surface then becoming dynamic. When rotation occurs at the OD seal surface, which is usually formed from a relatively soft elastomer and has a relatively poor wear resistance, the OD seal surface experiences severe wear, and the seal may fail after a short time.

The service life of bits equipped with such elastomeric seals is generally limited by the ability of the seal material to withstand the different temperature and pressure conditions at each dynamic and static seal surface. Where such seal components experience damage, the lubricant is able to escape, and cutting-laden drilling fluid is allowed to enter the seal gland causing still further deterioration and damage to the seal components. Eventually, enough cuttings may pass into the journal gap and/or enough lubricant may be lost from the bearing area such that rotation of the cone cutter is impeded and drilling dynamics are changed, eventually requiring the bit to be removed from the borehole. Accordingly, protecting the integrity of the seal is of utmost importance.

Additionally, to provide the appropriate sealing pressure and contact footprint, it is imperative that the seal and the seal gland be precisely manufactured. For example, if the gland is too large or the seal too small, the appropriate squeeze on the seal will not be provided and, in turn, the desired seal footprint and sealing pressure on the journal surface will be lacking. In such instances, the seal will not perform its intended function and the bit may prematurely fail. Likewise, if the seal is too large or the gland too small, an excessive sealing pressure and footprint may result, causing excessive heating and thermal failure of the seal. Once again, this can lead to bit failure. Accordingly, for these reasons, the seals must be precisely molded and the seal glands precisely machined to create the desired contact pressure and footprint on the journal shaft.

The requirement for the elastomeric seal to provide the precise contact pressure and footprint against the adjacent sealing surfaces creates difficulties for bit manufacturers. For example, an optimal seal design for a particular application may indicate that an elastomeric seal with a non-conventional or complex geometric profile be employed in the bit. This, in turn, may require a difficult-to-machine seal gland be formed in order to retain the non-conventional seal. In this instance, manufacturing the bit could be extremely expensive or even cost prohibitive, requiring that a compromise be made by the bit designer in which the bit design would surrender certain features desirable for good seal performance in order to ease manufacturing difficulties. As another example, for a given size of bit, the different rock formations and depth of borehole in which the bits are used may dictate different sealing pressures and footprints for these bits. Even for the same size bit, the manufacturer may be required to machine many types of seal glands for the same size of seals and bits, resulting in an increase in manufacturing cost. Still further, bit manufacturers make and inventory a wide variety of bit designs and, for each such design, there may be a relatively large number of sizes of such bits. In turn, the differing bit sizes require the manufacturer to make and inventory a relatively large number of cone cutters and seals. Depending upon the application and the particular design, the manufacturer may be required to manufacture a large number of O-ring seals and corresponding seal glands to meet its various requirements. In turn, this leads to the manufacturer being required to make and inventory a large number of seals of substantially similar construction and materials, but of a myriad of cross-sectional areas. Assembly of such bits must be carefully accomplished to be sure of identifying correctly the precise seal that is required for a particular bit that is being manufactured, and ensuring that the appropriate seal is installed in the seal gland. The manufacturing is further complicated and made more expensive by the requirement that this large number of differently-sized seal rings be molded and, once completed, retained in inventory. Similarly, a variety of different milling programs or procedures must be maintained in order to properly machine the correct seal gland for the particular cone being manufactured.

It is therefore desirable that a new, long lasting and effective seal assembly be devised that maintains the appropriate contact pressure and footprint, to provide the appropriate seal on the static and dynamic sealing surfaces. In addition, it would be desirable that the seal assembly allow drill bit manufacturers to manufacture a wide range of bit sizes while minimizing or reducing the number of different sized seals and seal glands that must be made and kept in inventory.

SUMMARY OF EXEMPLARY PREFERRED EMBODIMENTS

In one embodiment, a seal assembly for a drill bit includes an elastomeric annular sealing seal and an auxiliary annular seal member engaging the sealing seal, the sealing seal and the auxiliary seal member being disposed in a seal gland of the bit and collectively establishing a dynamic and a static seal.

In another embodiment, a drill bit includes a cone cutter rotatably mounted on a journal shaft, an elastomeric sealing seal disposed about the journal shaft in a seal gland, where the sealing seal includes a dynamic sealing surface for dynamically engaging the journal shaft and a static seal surface opposite from the dynamic sealing surface. The drill bit further includes at least one auxiliary annular seal member disposed about the journal shaft in the seal gland and engaging both the seal gland and the static surface of the sealing seal.

The drill bit and seal assemblies may include one or more auxiliary annular seal members in the seal gland engaging the static sealing surface of the sealing seal. The auxiliary seal members may include a seal engaging surface that is non-linear and, in certain embodiments, may be shaped to generally conform to the shape of the static sealing surface of the sealing seal. The seal engaging surface of the auxiliary seal member may be convex and receive a concaved outer surface of the sealing seal. The auxiliary annular seal members may be generally L-shaped in cross-section, circular or may include other shapes and may be of varying sizes. For example, in certain embodiments, the auxiliary annular seal member may itself have a convex seal-engaging surface that engages a convex surface of the sealing seal. More than one auxiliary seal member may be employed in a seal assembly.

In certain embodiments, the seal assembly and bit include a local lubricant reservoir adjacent to the sealing seal and bounded, in part, by the sealing seal and the auxiliary annular seal member.

In certain embodiments, where the auxiliary seal member includes an extending leg portion, the leg portion may extend to a location that is short of the journal surface of the cone cutter so as to leave a gap between the auxiliary seal member and the journal surface, the gap helping to form a localized lubricant reservoir.

In embodiments where a plurality of auxiliary seal members are employed, some of the plurality of auxiliary seal members comprise elastomeric materials that differ in properties, such as hardness and modulus of elasticity. The plurality of annular seal members are not bonded to one another and are not bonded to the sealing seal, but instead, the annular seal members and the sealing seal are all separate annular elements pressed into engagement with one another.

In certain embodiments, the auxiliary annular seal member includes a seal engaging surface, at least a portion of which has a shape that generally conforms to the outer surface of the sealing seal. The auxiliary annular seal members further may include a gland engaging surface having a shape that generally conforms to the shape of the seal gland.

Embodiments described herein thus comprise a combination of features and advantages directed to overcome some of the deficiencies or shortcomings of prior art seal assemblies and drill bits. The various characteristics mentioned above, as well as other features and characteristics described in more detail below, will be readily apparent to those skilled in the art upon reading the following detailed description of preferred embodiments, and by referring to the accompanying drawings.

BRIEF DESCRIPTION OF THE DRAWINGS

For a more detailed description of the preferred embodiments of the present invention, reference will now be made to the accompanying drawings, wherein.

DETAILED DESCRIPTION OF EXEMPLARY PREFERRED EMBODIMENTS

Figure 1:
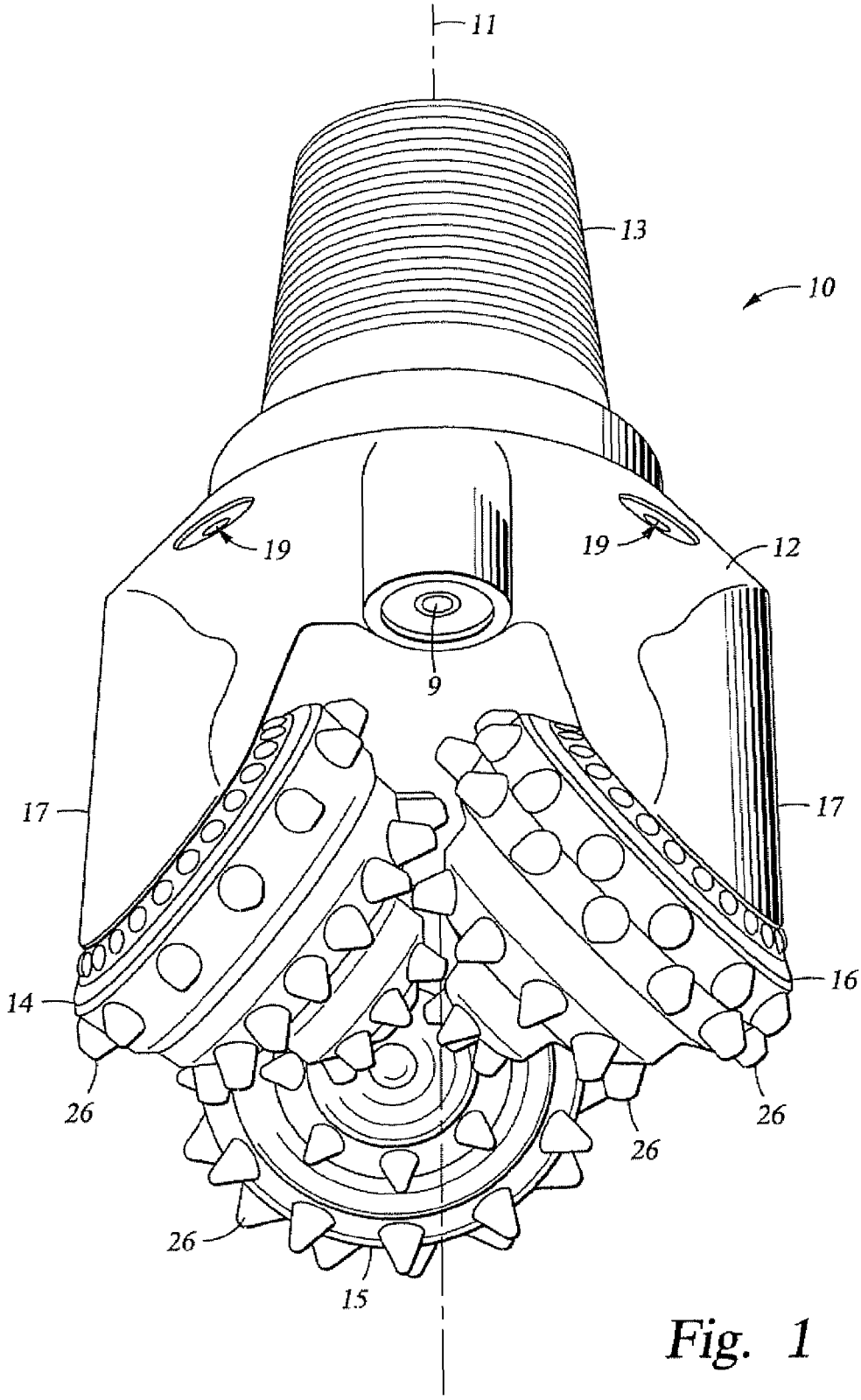
FIG. 1 is a perspective view of an earth boring bit.

Referring first to FIG. 1, an earth-boring bit 10 includes a central axis 11 and a bit body 12. Body 12 includes a threaded portion 13 on its upper end for securing the bit to the drill-string (not shown). Bit body 12 is composed of three sections or legs 17 that are joined together to form bit body 12. Rotatably connected to body 12 are three rolling cone cutters, 14, 15, 16 which include a plurality of cutter elements 26. Each cone cutter 14-16 is rotatably mounted on a journal pin or shaft 18 (FIG. 2) that is oriented generally downward and inward toward the center of bit 10. Each journal pin 18 and each cone cutter 14-16 is substantially the same, such that the description of one such journal pin 18 and one cone cutter 14 will adequately describe the others.

Bit 10 further including nozzles 9. Nozzles 9 are disposed in the bit body 12 so as to transmit a flow of drilling fluid from the interior of the drill bit 10 to a wellbore (not shown) and to a space proximate the roller cones 14-16. The flow of drilling fluid serves to cool the drill bit 10, clean the cutting elements 26, and to transport formation cuttings from the bottom of the wellbore to a wellbore annulus (not shown) and, subsequently, to the surface.

It is to be understood that seal assemblies are described herein with respect to a three cone bit for purposes of example only, and that the seal assemblies described herein may be employed in single cone bits, as well as in bits having two or more cones. Likewise, the seals described herein may have application beyond drill bits, and may be used wherever a shaft seal is required to seal between a rotatable member mounted on the shaft and a member that is stationary relative to the rotatable member.

Figure 2:
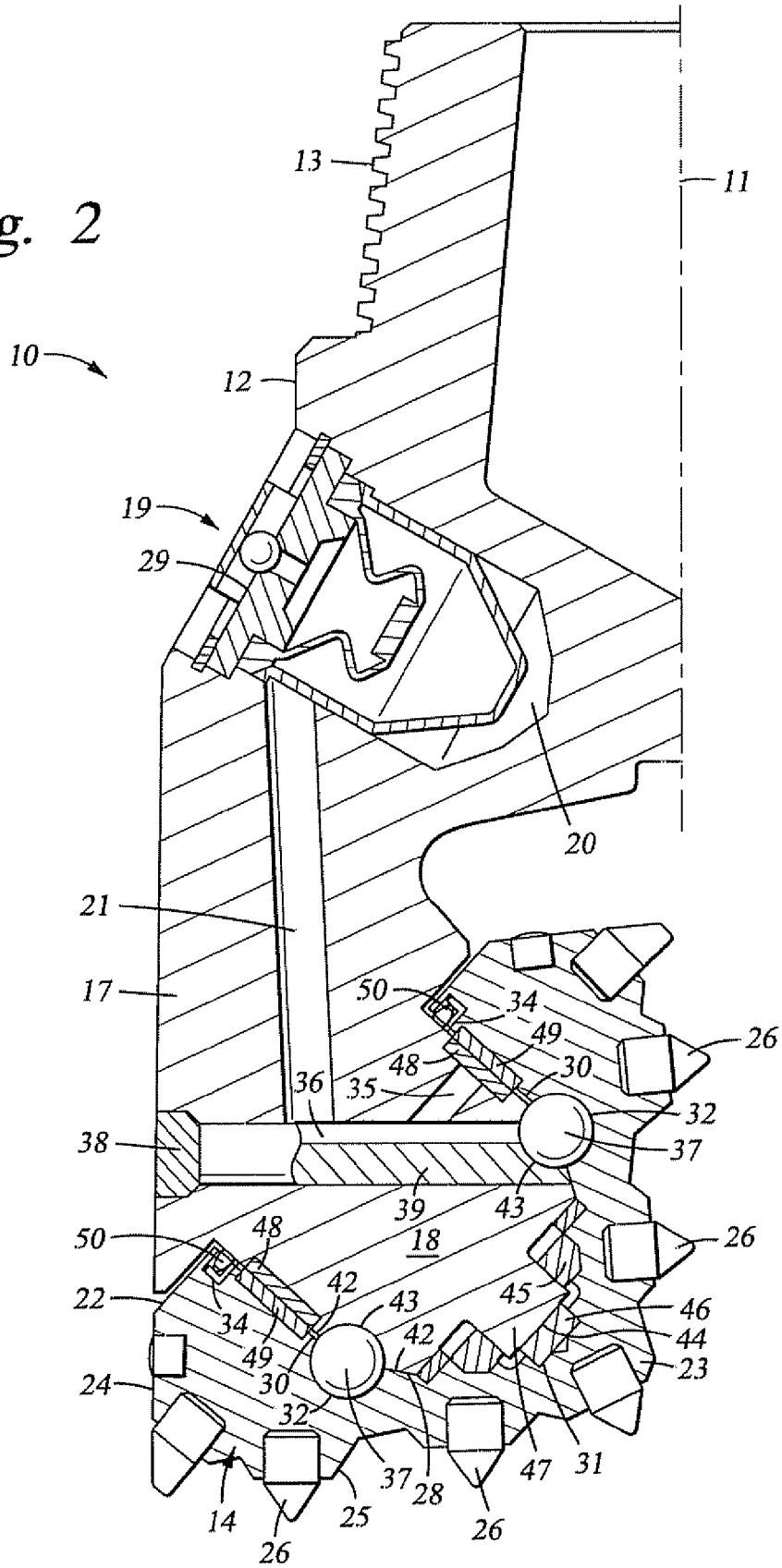
FIG. 2 is a partial section view taken through one leg and one rolling cone cutter of the bit shown in FIG. 1 and showing the seal assembly sealing between the rolling cone cutter and the leg of the bit body.

As best shown in FIG. 2, cone cutter 14 further includes a backface 22 and a nose portion 23 opposite backface 22. Cone 14 includes a frustoconical heel surface 24 and a generally conical surface 25 extending between heel surface 24 and nose 23. Secured within heel surface 24 and conical surface 25 are protruding cutter elements which, as depicted in FIGS. 1 and 2, comprise inserts 26, such as inserts made of tungsten carbide. Although not shown, the seals described herein may likewise be employed advantageously in "steel tooth" bits, also sometimes referred to as "milled tooth" bits, where the cutter elements are formed from the cone material, such as by a milling process, and coated with a hard-facing material.

Referring still to FIG. 2, cone cutter 14 includes a central cavity or bore 28, which receives the journal pin 18. Central bore 28 includes a bearing surface 30 and end surface 31. Formed in bearing surface 30 is a circumferential groove 32 for receiving a plurality of locking balls 37. Bearing surface 30 further includes a seal gland or recess 34 formed near back face 22. This gland may also be referred to as a seal groove 34.

Journal pin 18 includes a bearing surface 42 that is substantially concentric to bearing surface 30 in cone 14. Bearing surface 42 includes a groove 43 for receiving locking balls 37. A ball passageway 36 intersects groove 43 and forms a means by which locking balls 37 are placed into cone 14 during assembly. The locking balls retain cone 14 on the journal pin 18. After the balls 37 are in place, ball retainer 39 is inserted through ball passageway 36 and an end plug 38 is welded or otherwise secured to close off the ball passageway 36.

Journal pin 18 further includes a reduced diameter portion 47 and end-surface 44. Bearing surface 42 of pin 18 and bearing surface 30 of cone 14 may include cylindrical inlays 48, 49, respectively, that are disposed in grooves formed in the respective parts for reducing friction, such inlays being made, for example, of aluminum bronze alloys. A nose bushing 45 is disposed about reduced diameter portion 47 of pin 18. Cone 14 is disposed over the pin 18 with nose button 46 positioned between end-surface 44 and the end portion 31 of central bore 28. Seal assembly 50, shown schematically in FIG. 2 and described in more detail below, is disposed about journal pin 18 so as to seal between cone cutter 14 and journal pin 18.

The bearing structure described and shown FIG. 2 is generally known as a journal bearing. Other types of bits, particularly in bits having larger diameters and bits designed for higher rotational speeds, may include roller bearings disposed between the journal pin and the cone steel. It is to be understood that the seal assemblies described herein can be used with all types of rotary cone bits, including journal bearing and roller bearing bits, and in both rock bits and mining bits.

The bearing surfaces 30, 42 between the journal pin 18 and the cone 14 are lubricated by grease. The grease is applied so as to fill the regions adjacent to the bearing surfaces and to fill various interconnected passageways such that, upon bit assembly, air is essentially excluded from the interior of the bit. The bit includes a grease reservoir 19, including a pressure compensation subassembly 29 and a lubricant cavity 20 which is connected to the ball passageway 36 by lubricant passageway 21. The grease is retained in the bearing structure and the various passageways, including diagonal passageway 35 and passageways 21, 36, by means of seal assembly 50. Likewise, seal assembly 50 prevents drilled cuttings and abrasive drilling fluid from passing seal assembly 50 and washing out the lubricant and damaging the bearing surfaces. Details of the grease fill passage and system, as well as a typical grease system pressure compensation mechanism may be found, for example, in U.S. Pat. No. 6,170,830 issued to Cawthorne et al. and assigned to the assignee of the present invention. The lubricating grease reduces the friction and, as a result, the operating temperature of the bearings in the drill bit 10. Reduced friction increases drill bit performance and longevity, among other desirable properties.

Figure 3:
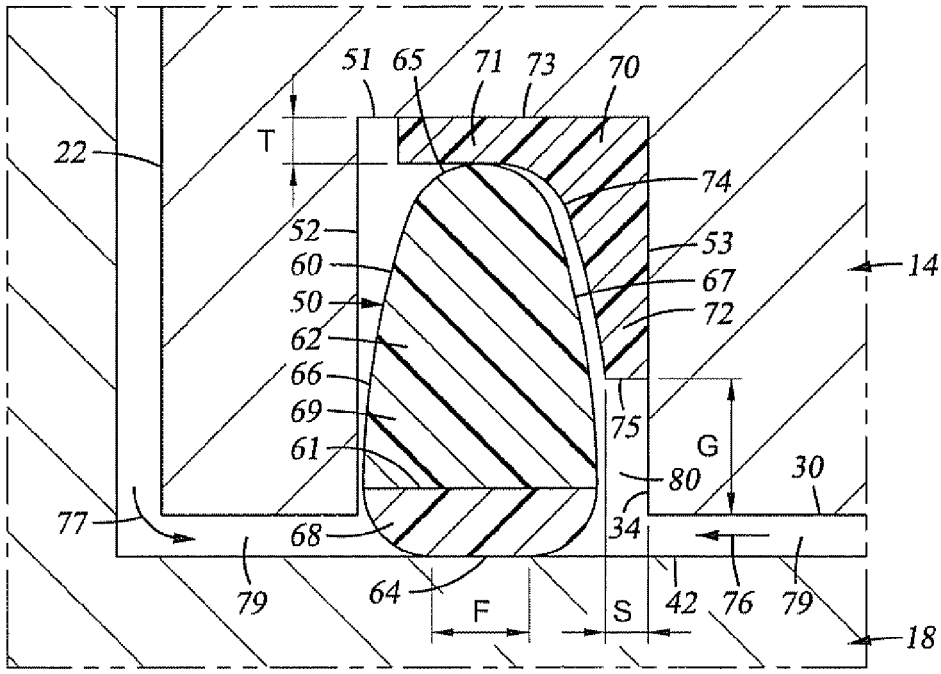
FIG. 3 is an enlarged cross-sectional view of the seal assembly shown in FIG. 2.

As shown in FIGS. 2 and 3, seal assembly 50 is disposed in a seal groove 34 that, in this particular embodiment, is formed in a surface 30 of the roller cone 14. The depiction of seal groove 34 in cone surface 30 is exemplary only. The seal groove 34 may alternatively be formed, for example, in surface 42 of the journal pin 18. The seal 50 is compressed radially by a predetermined amount in the seal groove 34. The compression, which is also referred to as "squeeze," is produced when the seal 50 is compressed between the surface 42 of the journal pin 18 and an inner surface 51 of the seal groove 34. The selected amount of compression may be varied, for example, by controlling either a radial thickness of the seal 50 or by controlling the depth of the seal groove 34.

Referring now to FIG. 3, seal assembly 50 generally includes seal groove or gland 34, sealing seal 60 and auxiliary seal 70. Seal groove 34 includes a bottom surface 51 and a pair of side surfaces 52, 53 that, in this embodiment are generally parallel to one another and generally perpendicular to journal surface 42 on journal shaft 18.

Sealing seal 60 generally includes an annular or ring-shaped seal body 62 having sealing surfaces on the inner and outer diameters thereof. The embodiment shown in FIG. 3 includes an inner diameter (ID) dynamic seal surface 64, an outer diameter (OD) static seal surface 65. In this embodiment, sealing seal 60 may be described as "bullet-shaped" and includes curved side surfaces 66 and 67 extending between OD sealing surface 65 and ID sealing surface 64, and sealing seal 60 defines an asymmetric cross-section that is wider at dynamic seal surface 64 than at static seal surface 65. However, it should be understood that seals having other cross-sectional shapes that may be symmetric or asymmetric may be employed. It is desired that the dynamic seal surface 64 seal against journal shaft 18 as it dynamically engages surface 42, and that static seal surface 65 remain stationary with respect to the surfaces 51-53 of seal groove 34.

Referring still to FIG. 3, seal body 62 includes a high-wear portion 68 forming ID seal surface 64. High-wear portion 68 is bonded to a less-wear resistant portion 69 at interface 61. In this asymmetrical cross-section, seal body 62 has an axial thickness at OD seal surface 65 that is less than the axial thickness of body 62 measured at ID seal surface 64. In this embodiment, high wear portion 68 of seal body 62 may be made from an elastomeric material having the following properties: a durometer hardness Shore A within the range of about 75 to 95; a modulus of elasticity at 100 percent elongation of from about 1000 to 2000 psi (6 to 12 megapascals); a minimum tensile strength of from about 3000 to 7000 psi (18 to 42 megapascals); elongation of from about 100 to 500 percent; die C tear strength of at least 100 lb/in. (1.8 kilogram/millimeter); and a compression set after 70 hours at 100° C. of less than about 20 percent.

Likewise, in this embodiment, portion 69 of seal body 62 may be made from an elastomeric material having the following properties: a durometer hardness Shore A within the range of about 60 to 80; a modulus of elasticity at 100 percent elongation of from about 300 to 900 psi (2 to 5 megapascals); a minimum tensile strength of from about 1100 to 4600 psi (7 to 28 megapascals); elongation of from about 200 to 1000 percent; die C tear strength of at least 100 lb/in. (1.8 kilogram/millimeter); and a compression set after 70 hours at 100° C. of less than about 15 percent.

Auxiliary seal 70 is an annular member having a generally L-shaped cross-section. Auxiliary seal member 70 includes base portion 71 and a leg portion 72. Auxiliary seal 70 further includes a gland-engaging surface 73 and a seal-engaging surface 74. Seal-engaging surface 74, in this embodiment, is concave and shaped to generally conform to the curved shape of side surface 67 of sealing seal 60. Auxiliary seal 70 is disposed in seal gland 34 with base portion 71 engaging bottom surface 51 of seal gland 34 and with leg portion 72 engaging side wall 53. In this arrangement, leg portion 72 is engaging the seal gland side wall 53 that is closest to groove 32 (FIG. 2) that receives locking balls 37 (FIG. 2). Gland-engaging surface 73 is configured generally to conform to the shape of the seal gland 34 and to provide the surface area necessary to provide the frictional force required to keep auxiliary seal 70 stationary with respect to seal gland 34.

In the embodiment shown in FIG. 3, grease enters the journal gap 79 formed between cone 14 and journal pin 18 and, as represented by arrow 76, is communicated along the journal gap at least to the location where ID dynamic seal surface 64 engages surface 42 of the journal pin 18. In fact, according to current seal understanding, it is believed that a film of such grease extends substantially to the mid-point of the area of contact or footprint if formed by ID seal surface 64 as it engages journal pin surface 42. Accordingly, side wall 53 is the side wall of the seal gland that is closest to the lubricant source. By contrast, side wall 52 is closest to the source of drilling fluid which enters between cone 14 and bit leg 17 and extends along the journal gap 79 up to sealing seal 60 as represented by arrow 77. It is presently believed that a film of drilling fluid extends between surface 42 of journal pin 18 and ID sealing surface 64 to the point that it comes to interface with the grease or lubricant.

In the embodiments described herein, the auxiliary seal member 70 is not bonded or otherwise attached to the sealing seal 60, but instead constitutes a separate seal element. In this way, the present seal assembly is distinguished from prior art annular seals that, rather than employing separate auxiliary seal members, simply used a single annular seal made from different materials bonded or molded together. In the embodiments described herein in which the auxiliary seal is a separate element, detrimental stresses at the interface between the different materials are avoided. In the instance of differing materials that are bonded together to form a single annular seal element as conventional in the prior art, due to the different materials and their differing thermal characteristics, stresses are imposed at the interface that can detrimentally affect the life of the seal and thus the life of the drill bit.

In the embodiment shown in FIG. 3, auxiliary seal 70 is made of a single elastomeric material and, for example, may have the following properties: a durometer hardness Shore A within the range of about 85 to 100; a modulus of elasticity at 100 percent elongation of from about 1500 to 3000 psi (9 to 18 megapascals); a minimum tensile strength of from about 3000 to 7000 psi (18 to 42 megapascals); elongation within the range of about 100 to 500 percent; die C tear strength of at least 100 lb/in. (1.8 kilogram/millimeter); and a compression set after 70 hours at 100° C. of less than about 20 percent.

Suitable elastomeric matexials useful for forming auxiliary seal 70 and portions 68 and 69 of sealing seal 60 include those selected from the group of fluoroelastomers, such as those rubber compounds used in the manufacture of gaskets and O-rings sold by E. I. du Pont de Nemours and Company under the trademark ADVANTA carboxylated elastomers such as carboxylated nitrites, highly saturated nitrile (HSN) elastomers, nitrile-butadiene rubber (HBR), highly saturated nitrile-butadiene rubber (HNBR) and the like.

In the embodiment of FIG. 3, it is preferred that leg portion 72 of auxiliary seal member 70 not extend entirely to bearing surface 30 but that, instead, end surface 75 of leg 72 extend to a height that is less than the length of side wall 53, leaving a gap of length G. Likewise, surface 75 of leg 72 includes a thickness "S" selected to provide a predetermined setoff between sealing seal 60 and side wall 53 of seal gland 34. Collectively, the dimensions of gap G and setoff S form a annular void 80. Annular void 80 is desirable to provide a local reservoir for the bit lubricant and to ensure that an adequate film of lubricant is provided to sealing seal 60 to avoid grease starvation and also to inhibit extrusion of the seal 60 into the journal gap 79 during bit operation.

It is desirable that the thickness T of base portion 71 (measured radially relative to journal pin 18) is dimensioned so as to provide the appropriate "squeeze" or pressure on sealing seal 60 when cone 14 is assembled on journal pin 18. As shown in FIG. 3, the thickness T of auxiliary seal base 71 may be increased in order to increase the sealing pressure and footprint of ID seal surface 64 on journal surface 42. Likewise, by selecting base 71 to have a thickness T that is less than that depicted in FIG. 3, the pressure applied to sealing seal 60 will be less, such that the sealing pressure and footprint of ID seal surface 64 on journal surface 42 will be less. In this manner, base portion 71 of auxiliary seal 70 generally may be considered an energizer for sealing seal 60. By appropriately selecting the elastomeric qualities, and the thickness T of base portion 71, the sealing pressure and the footprint between ID seal surface 64 and journal surface 42 may be varied as desired. Because the portion of seal engaging surface 74 of base portion 71 may be non-linear, as described herein, the thickness T is intended to be measured from gland surface 51 to the point where base portion 71 first contacts sealing seal 60 upon assembly of bit 10, prior to sealing seal 60 being compressed.

In a similar manner, varying the thickness of leg portion 72 also affects the space available for axial motion of sealing seal 60 relative to seal gland 34. Too much void space would detrimentally affect the sealing seal's ability to remain static with respect to cone 14, however some space is desirable to allow for thermal expansion of seal 60. Selecting an auxiliary seal member 70 with a thicker leg 72 may permit a relatively small sealing seal 60 to be employed in a relatively large seal gland and still provide the necessary contact pressure and frictional force to seal effectively and resist rotation. The auxiliary seal member 70 may be fashioned to energize sealing seal 60 in a bi-directional manner and to provide geometric adjustments necessary to make a given sized and configured sealing seal 60 compatible in a number of differently-sized seal glands.

Upon assembly of drill bit 10, auxiliary seal member 70 is positioned within seal gland 34 of cone 14. Sealing seal 60 is disposed in seal gland 34 so that it engages seal-engaging surface 74 of auxiliary seal 70. Thereafter, journal pin 18 is disposed in cone bore 28 with pin 18 passing through and engaging ID seal surface 64 of sealing seal 60. As previously described, locking balls 37 may then be inserted in order to lock cone 14 on journal pin 18.

The dimensions of seal gland 34, auxiliary seal member 70 and sealing seal 60, and the elastomeric qualities of sealing seal 60 and auxiliary seal member 70 determine the amount of "squeeze" applied to sealing seal 60 and, in turn, define the dimension of seal footprint F and the contact pressure exerted between the ID seal surface 64 and the journal surface 42. In addition, the shape, dimensions and material properties of auxiliary seal 70 and sealing seal 60 determine the frictional force applied to sealing seal 60. It is generally desired that seal 60 remain static with respect to auxiliary seal member 70 and seal gland 34, and that seal member 60 form a dynamic seal between ID seal surface 64 and journal surface 42. The materials of auxiliary seal 70 and sealing seal 60 may be selected such that greater (or lesser) frictional force exists between these members. The greater force is desired to ensure that sealing seal 60 remains static with respect to auxiliary seal member 70.

Lengthening leg 72, and thereby shortening gap G, increases the contact area between seal member 60 and auxiliary seal 70 and thereby tends to increase the frictional force and enhance the ability of auxiliary seal 70 and sealing seal 60 to remain static with respect to each other. Likewise, lengthening leg 72 can ensure that auxiliary seal member 70 remains static with respect to cone 14. As will be understood, shortening leg 72 has the opposite effect, and although it would increase gap G and provide greater space for lubricant, it would decrease the area of contact between the sealing seal 60 and the auxiliary seal member 70. Accordingly, selecting the height of leg 72 (and thus length of gap G), thickness T of base 71 and the materials of sealing seal 60 and auxiliary seal 70, in some cases, presents a compromise between competing design choices.

The use of auxiliary seal 70 in conjunction with the sealing seal 60 in a seal gland 34 also provides significant advantages in manufacturing. First, with the selection of an appropriately dimensioned auxiliary seal 70, an identical sealing seal may be employed in seal glands having varying dimensions. This may best be understood by first referring to FIG. 4A, which depicts a prior art sealing seal 90 disposed in a conventional seal gland 91, the sealing seal 90 includes a high-wear portion 92 forming the dynamic sealing surface. As shown, the seal assembly of the prior art FIG. 4A employs no auxiliary seal member 70. In this case, seal gland 91 and the sealing seal 90 must be precisely machined to create the appropriate radial squeeze on the sealing seal (appropriate to provide the desired seal pressure and footprint on journal surface 94). Similarly, the seal 90 and gland 91 must be precisely machined and properly designed to ensure that the desirable amount of lubricant may flow to the seal.

Figure 4A:
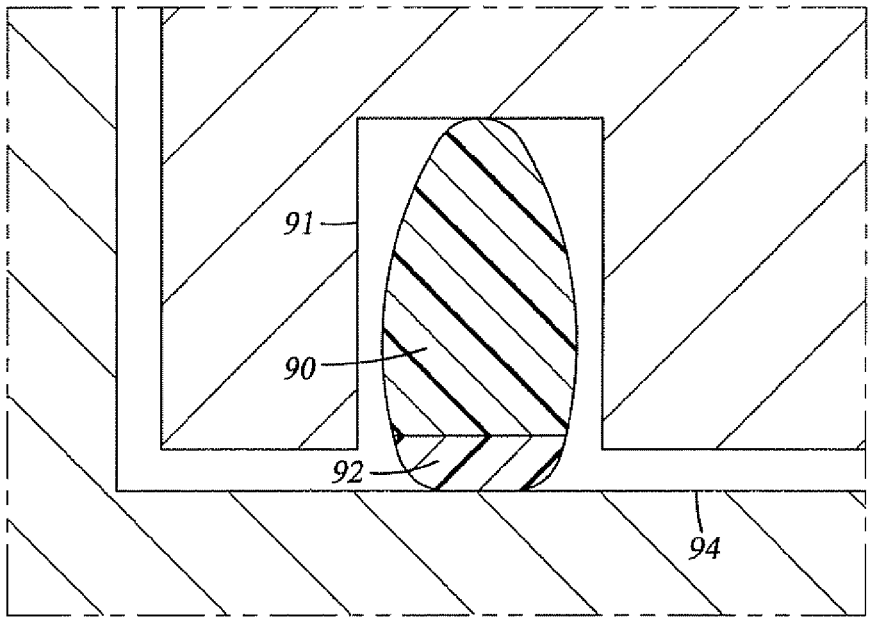
Fig. 4A (PRIOR ART)
FIGS. 4A and 4B are cross-sectional views of prior art seal assemblies as employed in different-sized rolling cone bits.
Figure 4B:
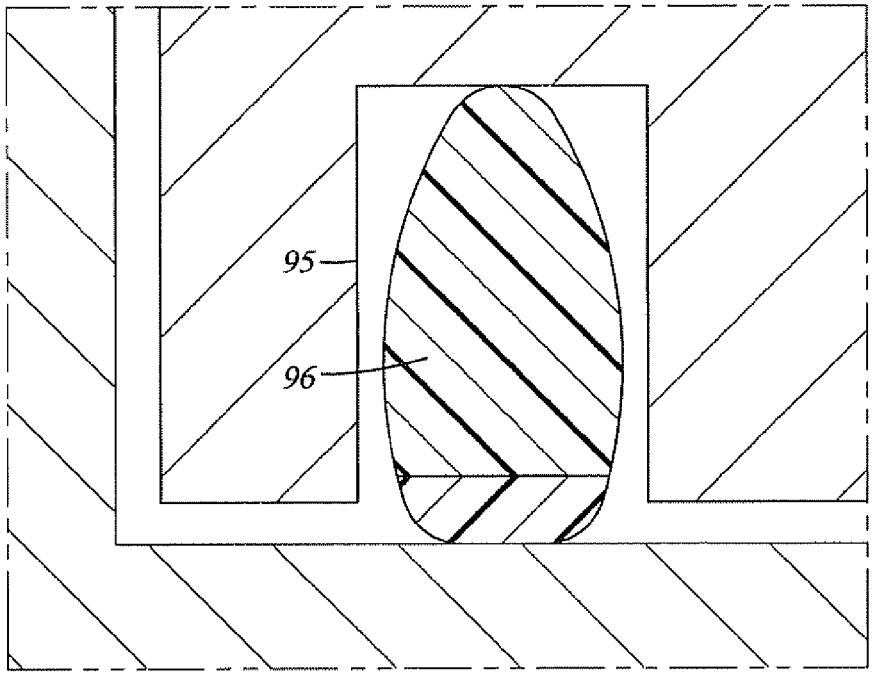
Fig. 4B (PRIOR ART)

Referring now to FIG. 4B showing a similarly designed prior art bit, but one having a larger seal gland 95 than gland 91 of the bit of FIG. 4A, this bit also required that a larger sealing seal 96 be provided in the seal gland 95 in order to perform the sealing function required. Accordingly, the bit manufacturer of the bits of FIGS. 4A and 4B was required to manufacture and inventory both the seals 90, 96. Given that a bit manufacturer may have dozens of sizes of different gland and seals for bits of the same general type or design, it will be understood that keeping these many different seals in inventory and ensuring that the proper seal is always employed in the proper gland is time consuming and thus costly.

Figure 5:
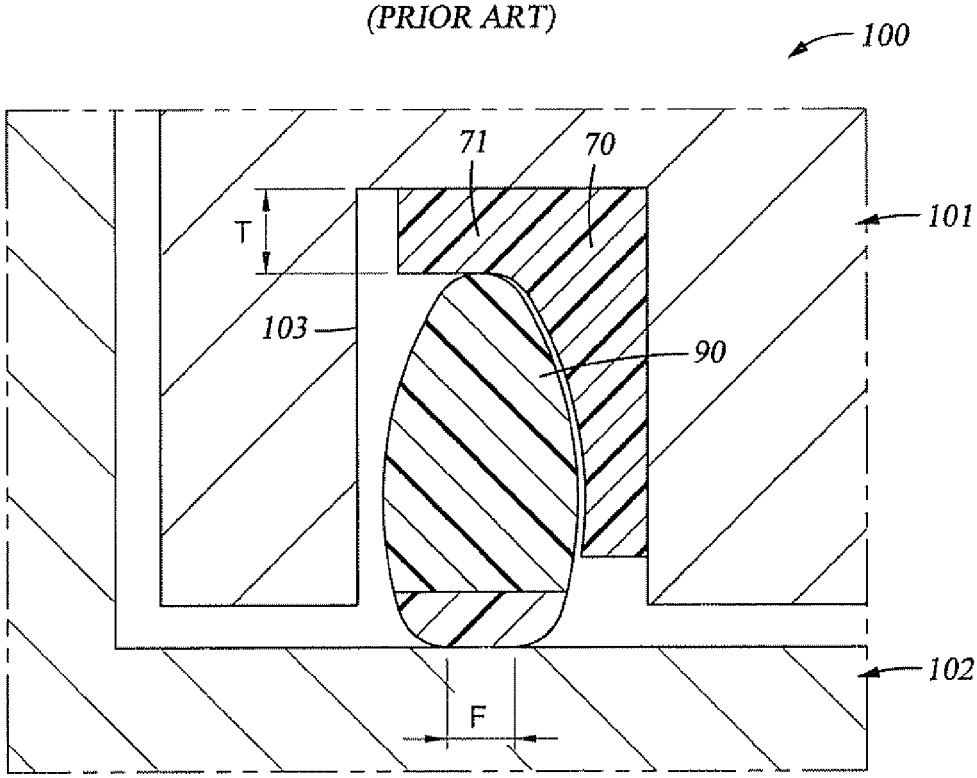
FIGS. 5 and 6 are enlarged cross-sectional views of seal assemblies suitable for use in the drill bit of FIG. 2.

By contrast, by employing the concept of an auxiliary seal member 70, a manufacturer may adopt a single sealing seal and affect the appropriate seal for many different sized drill bits merely by varying the size and elastomeric qualities of the auxiliary seal 70 that is employed. Referring to FIG. 5, a drill bit 100 is shown having rotatable cone cutter 101 disposed on journal pin 102. The cone cutter 101 includes a seal gland 103 identically sized to the seal gland 95 of the prior art bit shown in FIG. 4B. In this bit 100, however, a prior art seal such as the relatively small seal 90 of FIG. 4A may be employed even with the substantially larger seal gland 103. By contrast, in the prior art, with the larger seal gland 103, a relatively large sealing seal 96 would have been required as shown in FIG. 4B. However, in the embodiment of FIG. 5, the relatively small sealing seal 90 may be employed in the larger seal gland 103 by use of the auxiliary annular seal 70. In the embodiment of FIG. 5, the thickness T of base portion 71 of annular seal member 70 effectively decreases the depth of the seal gland 103 such that the relatively small sealing seal 90 may be employed in the larger seal gland 103.

Figure 6:
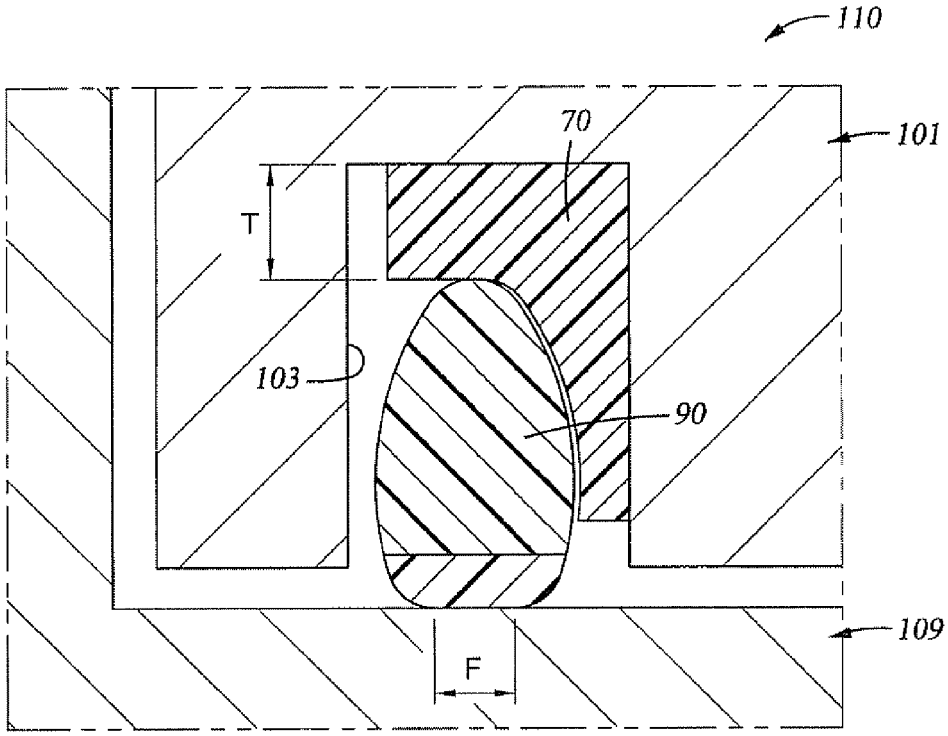

In a similar manner, and referring to FIG. 6, the same sealing seal 90 may be employed in bit 110 which again includes a relatively large sealing gland 108. In this embodiment, base portion 71 includes a thickness T that is substantially larger than the thickness of base portion 71 of auxiliary seal 70 in FIG. 5 so as to impart a larger radial squeeze on sealing seal 90 and increase the width of footprint F as compared to the embodiment of FIG. 5. By selecting the elastomeric qualities of auxiliary seal 70 and the thickness of base portion 71, a substantially greater squeeze may be imparted on sealing seal 90 so as to increase the contact pressure and footprint imparted by sealing seal 90 onto journal shaft 109 as may be desirable in certain applications. Thus, as illustrated in FIGS. 5 and 6, by selecting the appropriately sized auxiliary seal 70 and by selecting its elastomeric qualities, a single sealing seal 90 may be employed in numerous applications. In this instance, although requiring the bit manufacturer to inventory a number of different auxiliary seal members 70, the more costly process of precisely machining varying sized seal glands in the numerous cone cutters that are kept in inventory may be avoided. That is, many or all such cone cutters that are designed to accept a given sized journal pin may have the identically sized seal gland, use the identically sized sealing seal, and employ particular auxiliary seal members in order to account for size differences and desired contact pressures and footprints.

Figure 7:
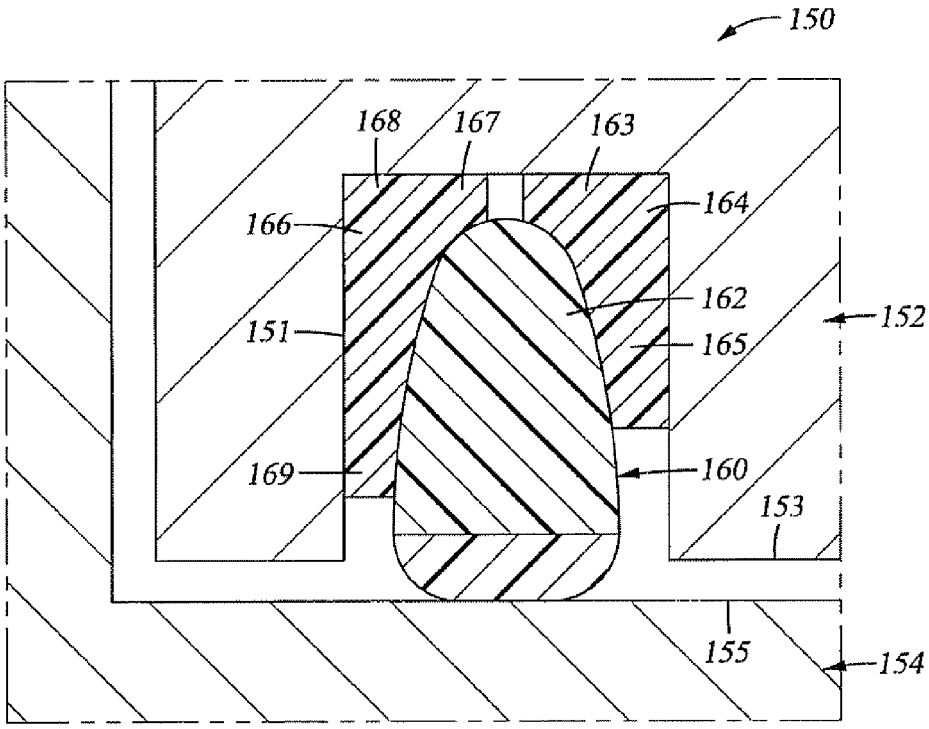
FIGS. 7-12 each show an enlarged cross-sectional view of an alternative seal assembly for sealing between the rolling cone cutter and bit body shown in FIG. 2.

Referring now to FIG. 7, a drill bit 150 is shown including cone cutter 152 rotatably mounted on journal shaft 154. Cone cutter 152 includes a seal gland 151 and a journal surface 153. Bit 150 further includes a seal assembly 160 including sealing seal 162 and auxiliary seals 164, 166. Sealing seal 162 is substantially identical to sealing seal 60 previously described with reference to FIG. 3. Likewise, auxiliary L-shaped seal 164 is substantially similar to auxiliary seal 70 described in FIG. 3. Auxiliary seal 166 is likewise substantially similar to auxiliary seal 70 of FIG. 3. However, as shown in FIG. 7, auxiliary seal 166 is disposed on the opposite side of sealing seal 162 from auxiliary seal 164. Auxiliary seal 166 includes a generally L-shaped cross-section, including base portion 168 and leg portion 169. Leg portion 169 extends substantially further toward journal surface 153 as compared to leg portion 165 of auxiliary seal member 164. This additional length is provided to increase the frictional force engaging sealing seal 162 and also to preclude a substantial volume of drilling fluid and cuttings to be collected adjacent to sealing seal 162. As previously described, with reference to FIG. 3, leg portion 165 does not extend to journal surface 153 so as to provide a local lubricant reservoir. Collectively, L-shaped auxiliary seal members 164, 166 engage sealing seal 162 and impart the appropriate squeeze on sealing seal 162 so as to, in turn, provide the appropriate contact pressure and footprint between sealing seal 162 and journal surface 155. The radial thickness T of base portions 163 and 167 of auxiliary seal members 164, 166 respectively, are selected to provide the appropriate degree of squeeze on sealing seal 162. The length of legs 169, 165 of auxiliary seals 166, 164 may be varied from that shown in FIG. 7 so as to increase or decrease the surface area on the sealing seal 162 that is engaged by the auxiliary seals and thereby prevent rotation of sealing seal 162 relative to cone 152. Although not shown in FIG. 7, in place of auxiliary seal members 164, 166, a single auxiliary seal member having a generally U-shaped cross-section may be employed instead in which the U-shaped seal member would include a base portion extending uninterruptedly across the bottom surface of gland 151 and having a pair of extending leg portions extending therefrom with the sealing seal 162 nested within the annular recess formed by the extending legs.

As compared with the embodiment shown in FIG. 3, the seal arrangement of FIG. 7 having dual auxiliary seal members may be particularly appropriate when a given size sealing seal 162 is to employed in a relatively large seal gland 151, on where a gland 151 would otherwise be too large in the axial dimension to permit use of sealing seal 162 and that, instead, would require a larger sealing seal. The addition of auxiliary seal 166 provides additional engagement and frictional force and further restricts the sealing seal's freedom for axial movement, thereby enhancing the ability of sealing seal 162 to remain stationary with respect to cone 152.

Figure 8:
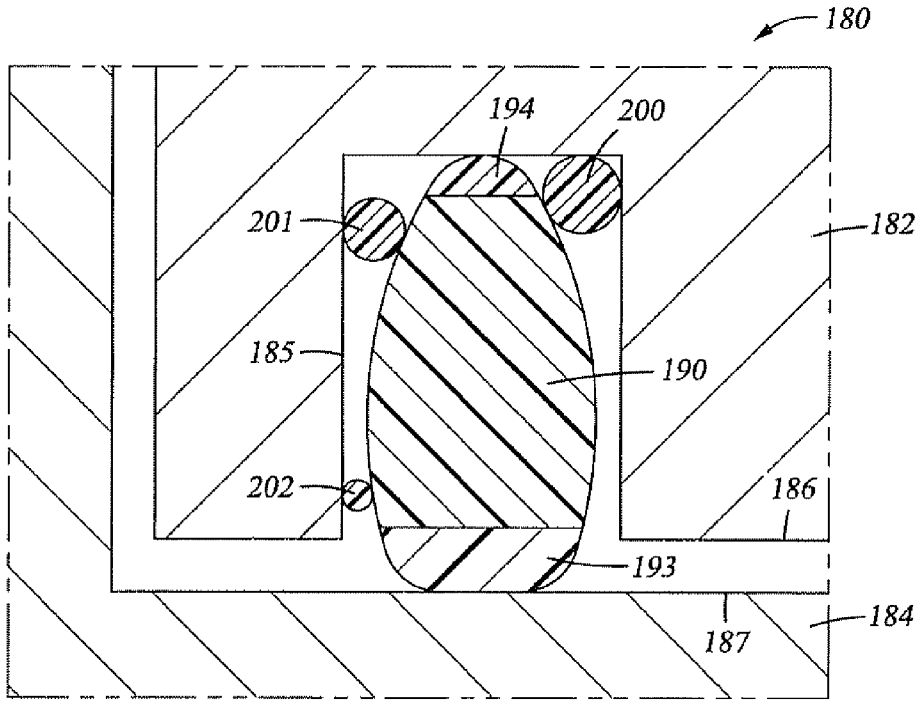

Another alternative seal arrangement is shown in FIG. 8 where drill bit 180 includes a cone cutter 182 rotatably mounted in journal pin 184. Cone cutter 182 includes a journal surface 186 and a seal gland 185. Cone journal surface 186 opposes journal surface 187 on journal pin 184. Drill bit 180 includes a sealing seal 190 disposed in seal gland 185. Sealing seal 190 includes a high-friction or wear-resistant material 193 at the inner diameter dynamic sealing surface, as well as a similar material 194 at the outer diameter static seal surface. In this embodiment, auxiliary seal members 200, 201 and 202 are included and are disposed between sealing seal 190 and seal gland 185. Auxiliary seal members 200-202 are generally annular members having convex outer surfaces and substantially circular cross-sections. Similarly, auxiliary seal members 200-202 may have oval or other cross-sectional shapes. Auxiliary seal members 200-202 perform substantially the same function as auxiliary seals described in the prior figures, although seals 201-202 provide substantially less surface area for engaging sealing seal 190 as compared, for example, to the auxiliary seal members 164, 166 having generally L-shaped cross-sections and described with reference to FIG. 7. By the appropriate selection of the size and position of auxiliary members 200-202, a relatively narrow (in the axial direction) sealing seal may be employed in a relatively large sealing gland 185.

Figure 9:
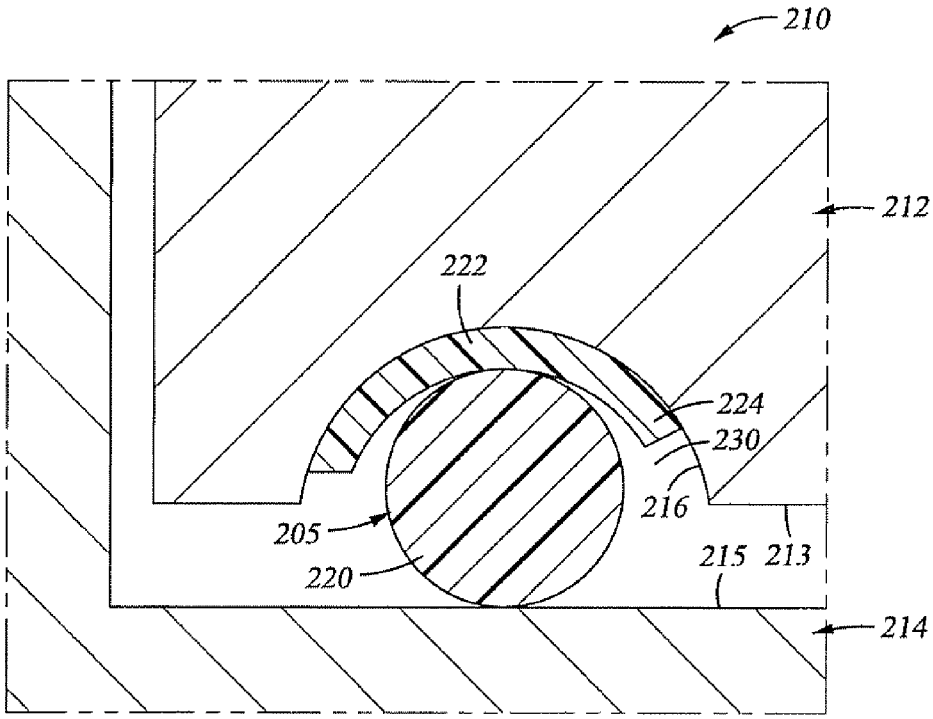

The sealing assemblies of the present design are not limited to seal glands having generally rectangular cross-sections. As shown in FIG. 9, a drill bit 210 includes cone cutter 212 rotatably mounted on journal shaft 214, and includes a seal assembly 205 and seal gland 216. Gland 216 generally comprises a annular recess having a curved profile in the form of a semicircle in this embodiment. Seal assembly 205 in bit 210 includes an annular sealing seal 220 having a generally circular cross-section and an auxiliary seal member 222 that is disposed between seal gland 216 and sealing seal 220. Auxiliary seal member 222 may be formed of a material similar to that of L-shaped auxiliary seal member 70 of FIG. 3. Auxiliary seal member 222 provides substantial fictional engagement with sealing seal 220 so as to prevent relative movement of seal 220. It is desirable that the edge 224 of auxiliary seal 222 that is closest to the source of grease spaced from and not extend to journal surface 213 such that, as previously described, a local grease reservoir at 230 is provided. To accommodate differing sized seal glands 216 but employ the same sealing seal 220, the thickness of auxiliary seal member 222 may be varied. For example, in an embodiment having a curved seal gland of diameter greater than seal gland 216, the same sealing seal 220 may be employed where auxiliary seal 222 has a greater thickness than that shown in FIG. 9. Similarly, where greater squeeze is desired on sealing seal 220 so as to impart greater squeeze on sealing seal 220 and greater contact pressure on journal surface 215 of journal pin 214, an auxiliary seal member having a greater radial thickness may be employed.

Figure 10:
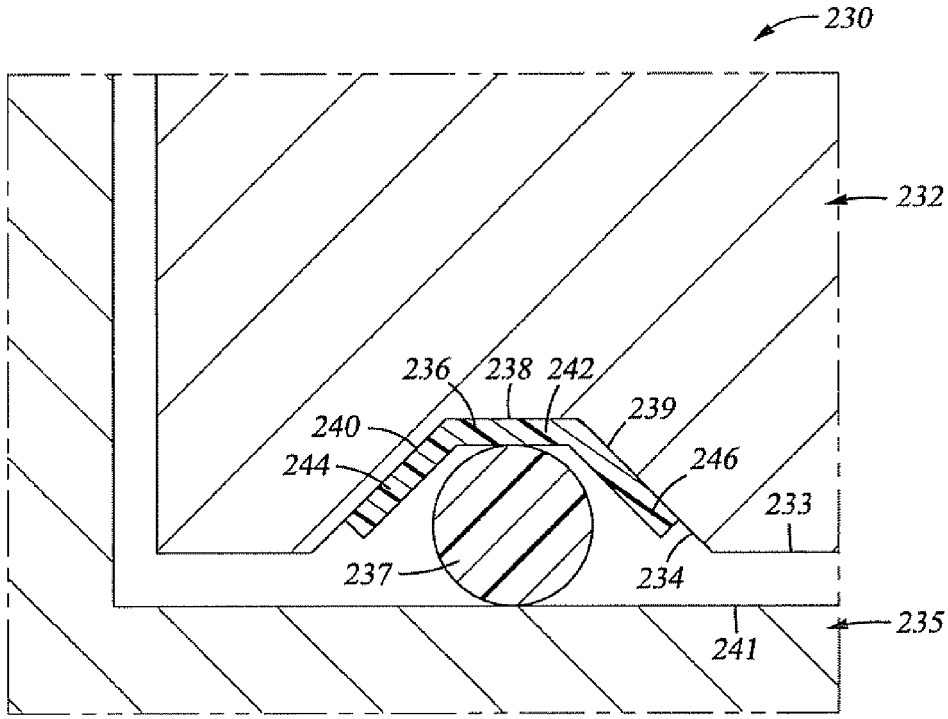

Another alternative embodiment is shown in FIG. 10, including drill bit 230 having rotatable cone cutter 232 mounted on journal pin 235. Cone cutter 232 includes journal surface 233 and a seal gland 234. Gland 234 includes, in cross-section, a generally flat section 238 and two opposing angled side portions 239, 240. Bit 230 includes a sealing seal 237 substantially the same as sealing seal 220 described with reference to FIG. 9. Bit 230 further includes an auxiliary seal member 236 disposed between sealing seal 237 and seal gland 234. Auxiliary seal member 236 of FIG. 10 is a generally annular member having a relatively flat base portion 242 and angled side extensions 244, 246 which, respectively, engage segments 240, 239 of seal gland 234. Considering the elastomeric qualities of auxiliary seal 236 and sealing seal 237, the thickness of the base portion 242 of auxiliary seal member 236 is selected to provide the appropriate squeeze on sealing seal 237 and, in turn, the appropriate sealing pressure and footprint on journal surface 241 of journal pin 235. Leg 246 of auxiliary seal member 242 does not extend to journal surface 233 of cone cutter 232 so as to provide a local grease reservoir adjacent to sealing seal 237. The size of seal gland 234, the thickness and elastomeric properties of base 238 and side portions 244, 246 of auxiliary seal member 236 may be appropriately selected such that a relatively small sealing seal 237 may be employed even in a relatively large sealing gland 234.

Figure 11:
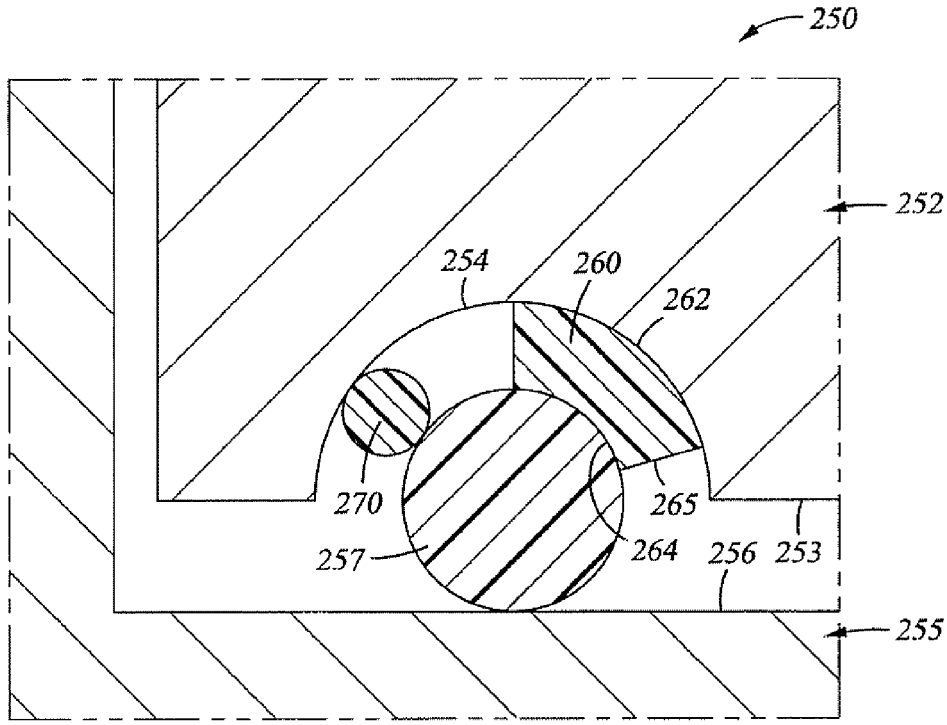

Referring to FIG. 11, another alternative embodiment is shown in which drill bit 250 includes rotatable cone cutter 252 rotatably mounted on journal shaft 255. Cone cutter 252 includes a seal gland 254 and a journal surface 253 that opposes journal surface 256 of pin 255. Bit 250 further includes an annular seal member 257 substantially the same as seal member 220 previously described with reference to FIG. 9. In bit 250, the seal assembly includes auxiliary seal members 260 and 270. Annular member 270 has a generally circular cross-section and may be, for example, substantially the same as the auxiliary member 200 previously described with reference to FIG. 8. Auxiliary member 260 includes a radially-outermost surface 262 that engages seal gland 254, and an inner radial surface 264 that engages sealing seal 257, surface 264 shaped to generally conform to the outer surface of sealing seal 257. In this embodiment, the cross-sectional diameter of annular member 270 is substantially the same as the thickness of auxiliary member 260 as measured radially between surfaces 262 and 264. The dimensions of members 260 and 270 are selected such that the appropriate squeeze is imparted to sealing seal 257. As described in previous embodiments, it is preferred that the edge 265 of auxiliary member 260 does not extend all the way to journal surface 253 so as to provide a local collection point for lubricant. By varying the elastomeric qualities and dimensions of auxiliary members 260 and 270, the same sealing seal 257 may be used in larger or smaller seal glands than seal gland 254 shown in FIG. 11.

Figure 12:
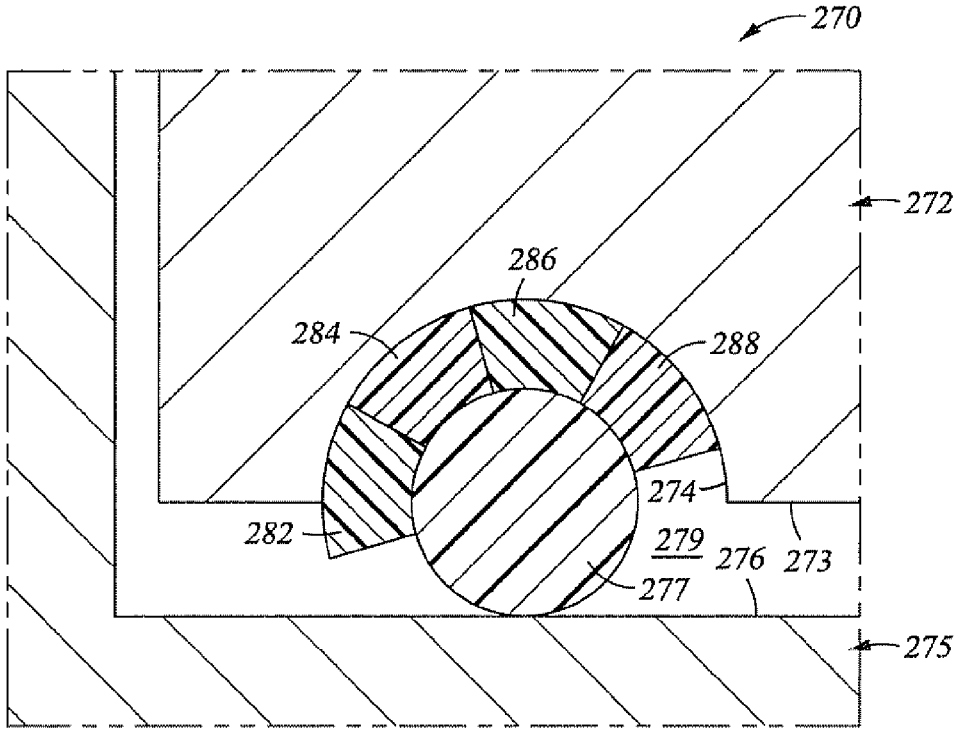

Referring now to FIG. 12, a further embodiment is shown including drill bit 270 having cone cutter 272 rotatably mounted on journal shaft 275. Cone cutter 272 includes seal gland 274 and journal surface 273. Journal shaft 275 includes journal surface 276 that generally opposes surface 273 of cone 272. In this embodiment, seal gland 274 and sealing seal 277 are substantially the same as gland 254 and sealing seal 257 previously described with reference to FIG. 11. In this embodiment, the seal assembly includes annular auxiliary seals 282, 284, 286, 288 that engage one another and are disposed between sealing seal 277 and sealing gland 274. It is preferred that auxiliary seal elements 282, 284, 286, 288 not be bonded to sealing seal 277 or to each other. This enables auxiliary seal members 282, 284, 286, 288 to be made of differing materials so as to provide differing degrees of squeeze to sealing seal 277. For example, in this embodiment, auxiliary seal member 282 is preferably made of the hardest material, with auxiliary seal members 284, 286, 288 being made of materials that are progressively softer. Auxiliary seal member 288 does not extend all the way to journal surface 273 so as to provide an annular void 279 for grease to collect adjacent sealing seal 277. Auxiliary seal member 282, by contrast, extends beyond journal surface 273 so as to provide a means to screen relatively large debris and prevent it from contacting sealing seal 277.

Figure 13:
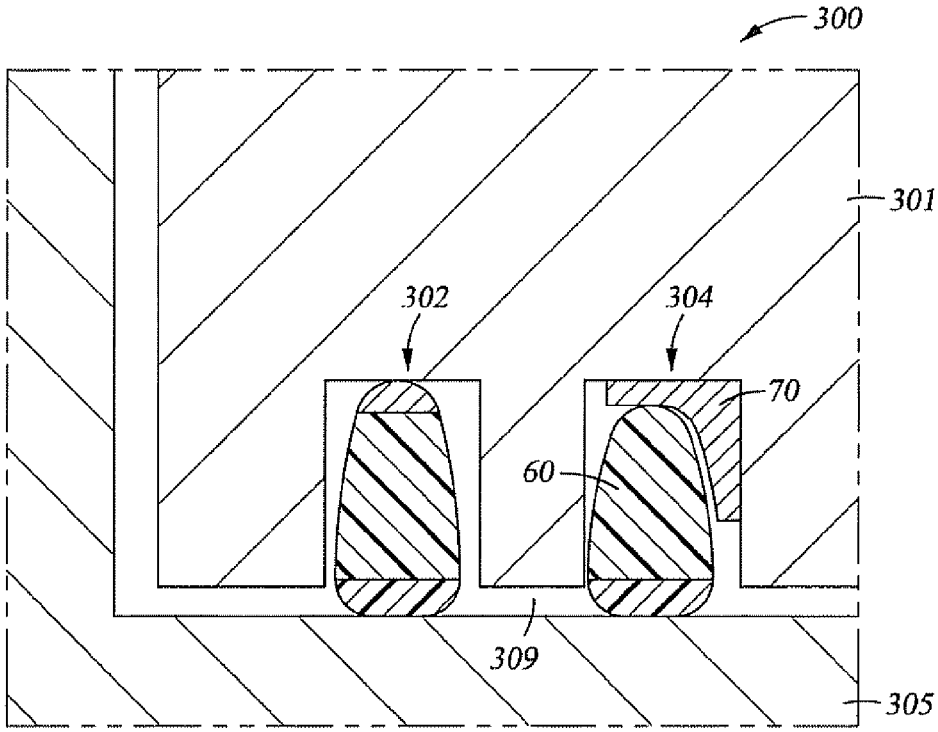
FIG. 13 is an enlarged cross-sectional view of another alternative seal assembly for sealing between the rolling cone cutter and the bit body of a rolling cone bit, the cone cutter in the embodiment employing dual seals.

Referring now to FIG. 13, another embodiment is shown in a drill bit 300 including dual seal assemblies 302, 304. In this embodiment, seal assembly 304 may be substantially identical to seal assembly 50 as previously described with reference to FIG. 3 and serves primarily to prevent lubricant from escaping. Seal assembly 302 is provided in cone cutter 301 as a secondary seal. More specifically, seal assembly 304 including sealing seal 60 and auxiliary seal 70 provide a primary seal and a primary means to retain lubricant between cone cutter 301 and journal shaft 305. Secondary seal assembly 302 includes annular sealing seal 305 substantially the same as seal 190 described with reference to FIG. 8. Secondary seal assembly 302 provides additional sealing, but its principal function is to prevent the abrasive-laden drilling fluid from penetrating into journal gap 309 and contacting the opposing bearing surfaces. Between seal assemblies 302 and 304, journal gap 309 is filled with grease and may or may not be connected to a relief vent that regulates the pressure between the seal assemblies in a previously-known manner. It should be understood, if desired, that secondary seal assembly 302 may be identical to seal assembly 304 such that it also would include a sealing seal and an auxiliary seal member.

The various preferred embodiments of the invention that have been showed and described are exemplary only, and are not limiting. Many variations and modifications of the embodiments disclosed herein are possible and within the scope of the invention. Accordingly, the scope of protection is not limited by the description set out above, but is only limited by the claims which follow, that scope including all equivalents of the subject matter of the claims.

What is claimed is:

1. A drill bit, comprising:

a cone cutter rotatably mounted on a journal shaft, said cone cutter including a seal gland;

an annular elastomeric sealing seal disposed about said journal shaft in said seal gland, said sealing seal including a first portion having a dynamic sealing surface for dynamically engaging said journal shaft and a second portion having a static sealing surface opposite said dynamic sealing surface, wherein the first portion comprises a first material and the second portion comprises a second material that is less wear resistant than the first material; and at least one elastomeric auxiliary annular seal member disposed about said journal shaft in said seal gland, said at least one auxiliary annular seal member engaging said static sealing surface of said sealing seal and statically engaging said seal gland;

wherein said at least one auxiliary annular seal member radially biases the dynamic sealing surface of the sealing seal against the journal shaft.

2. The drill bit of claim 1 wherein said auxiliary annular seal member has a generally L-shaped cross-section.

3. The drill bit of claim 2 wherein said auxiliary annular seal member includes a seal engaging surface that is non-linear.

4. The drill bit of claim 1 wherein said auxiliary annular seal member includes a seal engaging surface that is shaped to generally conform to the shape of said static sealing surface of said sealing seal.

5. The drill bit of claim 1 wherein said auxiliary annular seal member includes a seal engaging surface that includes a convex portion.

6. The drill bit of claim 1 wherein said auxiliary annular seal member includes a seal-engaging surface that includes a concave portion.

7. The drill bit of claim 1 wherein:

said cone cutter comprises a journal surface facing said journal shaft;

said seal gland includes a bottom surface and a side surface extending from said bottom surface to said journal surface of said cone cutter; and said auxiliary seal member includes a first portion engaging said bottom surface of said gland and a second portion engaging said side surface of said gland and extending from said first portion to a location that is a predetermined distance G away from said journal surface.

8. The drill bit of claim 7 wherein said second portion of said auxiliary annular seal member has a thickness S, when viewed in cross-section, and separates said sealing seal from said side surface of said seal gland.

9. The drill bit of claim 8 wherein at least one of said plurality of auxiliary annular seal members has a generally L-shaped cross-sectional area.

10. The drill bit of claim 8 wherein at least one of said plurality of auxiliary annular seal members is generally circular in cross-section.

11. The drill bit of claim 8 wherein at least two of said plurality of auxiliary annular seal members comprise elastomeric materials that differ in modulus of elasticity.

12. The drill bit of claim 8 wherein at least two of said plurality of auxiliary annular seal members engage one another but where said engaging auxiliary annular seal members are not bonded together.

13. The drill bit of claim 1 wherein said drill bit includes a plurality of auxiliary annular seal members disposed in said seal gland and engaging said static sealing surface of said sealing seal and engaging said seal gland.

14. The drill bit of claim 13 wherein at least one of said plurality of auxiliary annular seal members includes a seal-engaging surface that includes a convex portion.

15. The drill bit of claim 1 wherein said seal gland, when viewed in cross-section, comprises a curved surface; and wherein said auxiliary annular seal member comprises a curved surface engaging said curved surface of said seal gland.

16. The drill bit of claim 1 wherein said auxiliary annular seal member comprises an elastomeric material and wherein said annular elastomeric sealing seal is harder than said auxiliary annular seal member.

17. The drill bit of claim 1 wherein said sealing seal and said auxiliary seal member each include a convex surface, and wherein said convex surface of said auxiliary seal engages said convex surface of said sealing seal.

18. The drill bit of claim 1 wherein the first portion of the sealing seal is bonded to the second portion of the sealing seal.

19. A seal assembly for a drill bit having a cutter rotatably mounted on a journal shaft, said seal assembly comprising:

a seal gland formed between said journal shaft and said cutter;

an annular elastomeric sealing seal disposed about said shaft in said seal gland and including a first portion having a dynamic sealing surface and a second portion having a static sealing surface, wherein the first portion comprises a first material and the second portion comprises a second material that is less wear resistant than the first material; and at least a first auxiliary annular elastomeric member disposed in said seal gland between said sealing seal and said seal gland, said first auxiliary annular elastomeric member statically engaging said static sealing surface of said annular elastomeric sealing seal and statically engaging said seal gland;

wherein said first auxiliary annular seal member radially biases the dynamic sealing surface of the sealing seal against the journal shaft.

20. The seal assembly of claim 19 wherein said auxiliary annular member includes a gland engaging surface and a sealing seal engaging surface, and wherein said sealing seal engaging surface comprises a portion that is concave.

21. The seal assembly of claim 19 wherein said auxiliary annular member includes a gland engaging surface and a sealing seal engaging surface, and wherein said sealing seal engaging surface comprises a portion that is convex.

22. The seal assembly of claim 19 wherein said auxiliary annular seal member includes a seal engaging surface that includes a portion that generally conforms to the shape of a portion of said sealing seal.

23. The seal assembly of claim 19 wherein said auxiliary annular seal member, when viewed in cross-section, is generally L-shaped.

24. The seal assembly of claim 19 wherein said seal gland includes a bottom surface and side surface extending from said bottom surface; and wherein said auxiliary annular seal member includes a first portion engaging said bottom surface of said gland and a second portion engaging said side surface of said gland and extending from said first portion.

25. The seal assembly of claim 19 further comprising a lubricant reservoir adjacent said sealing seal and bounded in part by said sealing seal, said auxiliary annular seal member, and the journal shaft.

26. The seal assembly of claim 19 wherein said cutter includes a journal surface facing said journal shaft and wherein said seal gland includes a side surface extending to said journal surface; and wherein said auxiliary annular seal member includes a portion extending along said side surface to a predetermined location that is a distance G away from said journal surface.

27. The seal assembly of claim 26 further including a second auxiliary annular elastomeric member disposed in said sealing gland between said sealing seal and said seal gland, said second auxiliary annular member including a portion extending to a location beyond the journal surface of said cutter.

28. The seal assembly of claim 19 further comprising a plurality of auxiliary annular elastomeric members in said sealing gland engaging said sealing seal and engaging said seal gland.

29. The seal assembly of claim 28 wherein at least one of said plurality of auxiliary annular elastomeric members includes a curved surface engaging said sealing seal.

30. The seal assembly of claim 19 wherein said sealing seal and said auxiliary seal member each include a convex surface, and wherein said convex surface of said auxiliary seal engages said convex surface of said sealing seal.

31. The drill bit of claim 19 wherein the first portion of the sealing seal is bonded to the second portion of the sealing seal.

32. A drill bit comprising:

a shaft;

a cutter element rotatably mounted on said shaft, said shaft and said cutter element having concentric journal surfaces separated by a journal gap;

at least a first seal gland including an elastomeric sealing seal, said sealing seal comprising a first portion having a dynamic sealing surface for sealingly engaging one of said journal surfaces as said cutter element rotates relative to said shaft, and a second portion having a static sealing surface opposite said dynamic sealing surface, wherein the first portion comprises a first material and the second portion comprises a second material that is less wear resistant than the first material; and at least a first auxiliary elastomeric annular seal member disposed between said static sealing surface of said sealing seal and said seal gland, wherein said first auxiliary annular seal member statically engages said seal gland and frictionally engages said sealing seal for preventing relative motion of said sealing seal relative to said seal gland;

wherein said first auxiliary annular seal member radially biases the dynamic sealing surface of the sealing seal against the shaft.

33. The drill bit of claim 32 wherein said auxiliary annular seal member is not bonded to said sealing seal.

34. The seal assembly of claim 32 wherein said static sealing surface of said sealing seal includes a curved portion.

35. The drill bit of claim 34 wherein said auxiliary annular seal member includes a seal engaging surface that includes a concave portion.

36. The drill bit of claim 32 wherein said auxiliary annular seal member includes an extending portion that extends to a location short of said journal surface of said cutter element, forming a gap having radial dimension G between said extending portion and said journal surface.

37. The drill bit of claim 36 further comprising a lubricant reservoir adjacent said sealing seal and bounded, in part, by said journal surface of said cutter element, said extending portion of said auxiliary seal member, said sealing seal, and said journal surface of said shaft.

38. The drill bit of claim 32 further comprising a second seal gland, said second seal gland spaced apart from said first seal gland and including a second sealing seal comprising a dynamic sealing surface for sealingly engaging one of said journal surfaces as said cutter element rotates relative to said shaft, and a static sealing surface opposite said dynamic sealing surface.

39. The drill bit of claim 38 further comprising a second auxiliary annular seal member disposed between said static sealing surface of said second sealing seal and said second seal gland and frictionally engaging said second sealing seal for preventing relative motion of said second sealing seal relative to said second seal gland.

40. The drill bit of claim 32 further comprising a plurality of auxiliary annular seal members disposed between said static sealing surface of said sealing seal and said sealing gland and frictionally engaging said sealing seal.

41. The seal assembly of claim 32 further comprising a plurality of auxiliary annular seal members between said static sealing surface of said sealing seal and said seal gland and frictionally engaging said sealing seal for preventing relative motion thereof relative to said seal gland; and wherein at least one of said auxiliary annular seal members is generally L-shaped in cross-section and includes a seal engaging surface that includes a concave portion.

42. The drill bit of claim 32 wherein the first portion of the sealing seal is bonded to the second portion of the sealing seal.

43. A drill bit comprising:

a rolling cone cutter rotatably mounted on a journal surface of a shaft;

an elastomeric auxiliary annular seal member statically engaging said cone cutter and disposed about said shaft;

an annular elastomeric sealing seal engaging said auxiliary annular seal member and disposed about said shaft, said sealing seal including a first portion having a dynamic sealing surface that sealingly engages said journal surface of said shaft and a second portion having a static sealing surface that sealingly engages said auxiliary annular seal member, wherein the first portion comprises a first material and the second portion comprises a second material that is less wear resistant than the first material;

wherein said auxiliary annular seal member radially biases the dynamic sealing surface of the sealing seal against the journal surface of the shaft;

wherein said auxiliary seal member and said sealing seal are unbonded to one another.

44. The drill bit of claim 43 wherein said auxiliary seal member includes a concave surface engaging said sealing seal.

45. The drill bit of claim 43 wherein said auxiliary seal member is generally L-shaped in cross-section having a first portion extending from a second portion and having a curved surface extending between said first and second portions and engaging said sealing seal.

46. The drill bit of claim 45 wherein said first portion is shorter than said second portion.

47. The drill bit of claim 43 wherein said drill bit includes a plurality of auxiliary annular seal members engaging said cone cutter and a portion of said sealing seal.

48. The drill bit of claim 47 wherein at least one of said plurality of auxiliary seal members includes a concave surface engaging said sealing seal.

49. The drill bit of claim 47 wherein at least two of said plurality of auxiliary seal members comprise elastomeric materials that differ in hardness.

50. The drill bit of claim 43 further comprising an annular grease reservoir adjacent said sealing seal and bounded, in part, by said sealing seal and said auxiliary seal member.

51. The drill bit of claim 43 further comprising a seal gland, wherein said auxiliary annular seal member and said sealing seal are disposed in said seal gland, and wherein said auxiliary annular seal member includes a gland engaging surface in contact with said seal gland, said gland engaging surface having a shape generally conforming to the shape of said seal gland.

52. The drill bit of claim 51 wherein said auxiliary annular seal member includes a concave surface that generally conforms to the shape of said sealing seal.

53. The drill bit of claim 43 wherein the first portion of the sealing seal is bonded to the second portion of the sealing seal.

* * * * *